US010661977B2

(12) United States Patent
Veret et al.

(10) Patent No.: US 10,661,977 B2
(45) Date of Patent: May 26, 2020

(54) BLANK FOR ASSEMBLING A DEVICE FOR PACKAGING AT LEAST ONE WINDSCREEN WIPER

(71) Applicant: Valeo Systèmes d'Essuyage, Le Mesnil Saint Denis (FR)

(72) Inventors: Jocelyn Veret, Etrepagny (FR); Charlotte Aube, Courcelles les Gisors (FR)

(73) Assignee: Valeo Systèmes d'Essuyage, Le Mesnil Saint Denis (FR)

( * ) Notice: Subject to any disclaimer, the term of this patent is extended or adjusted under 35 U.S.C. 154(b) by 462 days.

(21) Appl. No.: 15/053,275

(22) Filed: Feb. 25, 2016

(65) Prior Publication Data

US 2016/0251145 A1 Sep. 1, 2016

(30) Foreign Application Priority Data

Feb. 27, 2015 (FR) ..... 15 51691

(51) Int. Cl.
*B65D 85/68* (2006.01)
*B65D 81/02* (2006.01)
(Continued)

(52) U.S. Cl.
CPC ..... *B65D 85/68* (2013.01); *B65D 5/02* (2013.01); *B65D 5/0209* (2013.01);
(Continued)

(58) Field of Classification Search
CPC ..... B65D 21/0201; B65D 21/0202; B65D 2585/6885; B65D 2585/6897; B65D 5/02;
(Continued)

(56) References Cited

U.S. PATENT DOCUMENTS 2,964,227 A * 12/1960 Goldsholl ..... B65D 5/0209 229/128
3,010,571 A * 11/1961 Transport ..... B65D 5/0209 206/758

(Continued)

FOREIGN PATENT DOCUMENTS

CN 102421681 A 4/2012
CN 202687146 U 1/2013

(Continued)

OTHER PUBLICATIONS

Preliminary Search Report issued in corresponding French Application No. FR1551691, dated Oct. 19, 2015 (8 pages).

(Continued)

*Primary Examiner* — Steven A. Reynolds
(74) *Attorney, Agent, or Firm* — Osha Liang LLP

(57) ABSTRACT

Blank (1) for assembling a device for packaging at least one windscreen wiper, said blank (1) being of elongate shape and comprising at least two adjacent longitudinal areas (2, 3) that can be articulated to one another via a longitudinal folding line (4), each longitudinal area (2, 3) being intended to form a longitudinal face of the packaging device, at least one of the longitudinal areas (2, 3) being further articulated at each of its longitudinal ends to an end area (21, 22; 31, 32), via a transverse folding line (5, 6; 7, 8), each end area (21, 22; 31, 32) being adapted to form a substantially transverse end face of the packaging device, said blank (1) being characterized in that it includes, at one of its longitudinal ends at least, longitudinal shock absorbing means (11) situated at the level of the longitudinal folding line (4) and spaced longitudinally and/or extending to a point spaced longitudinally from the transverse folding line or lines (5, 6; 7, 8) of the corresponding longitudinal end of the blank (1).

9 Claims, 3 Drawing Sheets

(51) Int. Cl.
*B65D 5/02* (2006.01)
*B65D 5/42* (2006.01)

(52) U.S. Cl.
CPC ..... *B65D 5/4266* (2013.01); *B65D 81/02* (2013.01); *B65D 81/022* (2013.01); *B65D 5/4208* (2013.01); *B65D 2585/6885* (2013.01); *B65D 2585/6897* (2013.01)

(58) Field of Classification Search
CPC .. B65D 5/0209; B65D 5/4208; B65D 5/4266; B65D 81/02; B65D 81/022; B65D 85/68; Y10S 220/92
USPC ..... 206/335, 464, 467, 806; 220/23.8, 23.4, 220/23.2, 23.83, 920, 918; 229/87.02
See application file for complete search history.

(56) References Cited

U.S. PATENT DOCUMENTS 3,343,743 A * 9/1967 Hamilton, Jr. ..... B65D 5/0209 229/117.24
3,637,130 A * 1/1972 Farquhar ..... B65D 5/0209 206/562
3,765,594 A * 10/1973 Cramphorn ..... B65D 5/0209 229/106
3,929,222 A * 12/1975 Smith ..... B65D 5/0209 206/783
D248,375 S * 7/1978 Bergstein ..... D9/415
4,860,886 A * 8/1989 Northrup ..... B65D 5/524 206/45.29
5,911,358 A * 6/1999 Kenner ..... B65D 5/0209 229/116.1
6,158,579 A * 12/2000 Rosenbaum ..... B65D 5/48026 206/45.29
6,719,128 B2 * 4/2004 Alpern ..... A61B 17/06133 206/380
7,690,509 B2 * 4/2010 Herring ..... B60S 1/3848 206/461
8,434,621 B2 * 5/2013 Hun ..... B65D 5/0209 206/464
9,096,360 B2 * 8/2015 Rajter, Jr. ..... B65D 75/56
9,102,436 B2 * 8/2015 Rajter, Jr. ..... B65D 5/103
D787,312 S * 5/2017 Peers ..... D9/415
2001/0035359 A1 * 11/2001 Sedon ..... E05B 73/0023 206/308.2
2003/0185942 A1 * 10/2003 Bishop ..... B65D 85/8085 426/77
2008/0073246 A1 * 3/2008 Herring ..... B60S 1/3848 206/776
2010/0301108 A1 12/2010 Wisecarver et al.
2014/0069847 A1 * 3/2014 Kim ..... B65D 5/029 206/784
2014/0162736 A1 * 6/2014 Shin ..... H04B 1/3888 455/575.8

FOREIGN PATENT DOCUMENTS

DE 7440161 U 4/1975
EP 2146905 A1 1/2010
WO 2008116662 A1 10/2008

OTHER PUBLICATIONS

First Office Action in corresponding Chinese Application No. 201610255122.4, dated Sep. 12, 2018 (12 pages).

* cited by examiner

BLANK FOR ASSEMBLING A DEVICE FOR PACKAGING AT LEAST ONE WINDSCREEN WIPER

The present invention concerns a blank for assembling a device for packaging at least one windscreen wiper and a device for packaging at least one windscreen wiper assembled from said blank. It also consists in a method of assembling the packaging device. The invention applies very particularly although not exclusively to packaging windscreen wipers in which the wiper blade is curved in the unrestricted rest state.

A motor vehicle is routinely equipped with a windscreen wiping system for wiping the windscreen and preventing interference with the driver's view of their environment. Such a system generally includes one or two windscreen wipers that carry wiper blades made from an elastic material. These blades, positioned with one in front of the driver and the other in front of the passenger, rub against the windscreen and evacuate water out of their field of view.

There exists at present a new generation of windscreen wipers the particular feature of which is having no swing-arm structures, in contrast to the straight blade wipers commonly employed. This new type of wiper, known as a flat blade wiper, still employs a flexible squeegee blade but the external armature for supporting it is replaced by a flexible structure that is integrated directly into the blade. The assembly is arranged so that, at rest, the blade has in the longitudinal direction a concave shape in its sagittal plane whereas, in contact with a surface to be wiped, said blade is able to straighten through elastic deformation of its flexible structure in order to espouse optimally said surface throughout its movement.

Precisely because of its curved shape, such a windscreen wiper with a curved blade may at rest have a much greater overall size than its counterpart with a swing-arm structure and a straight blade. It is therefore desirable to employ a packaging device of elongate shape that makes it possible to straighten the wiper in a straight position in order to reduce the overall size of the wiper.

It is known to use for this purpose for assembling the packaging device a blank comprising two adjacent longitudinal areas that can be articulated to each other via a longitudinal folding line, each longitudinal area being intended to form a longitudinal face of the packaging device. At least one of the longitudinal areas is further articulated at each of its longitudinal ends to an end area via a transverse folding line. Each end area is adapted to form a substantially transverse end face of the packaging device. The packaging device is then assembled by folding the blank along the line and then fastening together the longitudinal areas, for example by means of an adhesive longitudinal flap connected to the one of the longitudinal faces so as to form a transversely closed contour comprising the longitudinal faces of the packaging device. Assembly of the packaging device is completed by folding the end areas of the blank in the direction of the transversely closed contour so as to form the transverse end faces of the packaging device.

A packaging device assembled from such a blank has the drawback of being fragile in the event of an external impact. In particular, if the packaging device is dropped or struck by an external object, especially at the longitudinal ends of the device, there is a risk of the packaging device breaking and the wiper may be damaged.

The present invention aims to remedy these drawbacks by proposing a blank for assembling a packaging device suitable in particular for packaging curved blade windscreen wipers, but also for packaging swing-arm windscreen wipers, said blank making it possible to produce a packaging device having good resistance to impacts, in particular impacts at a transverse end of the device, typically if the packaging device is dropped.

The invention therefore consists in a blank for assembling a device for packaging at least one windscreen wiper, said blank being of elongate shape and comprising at least two adjacent longitudinal areas that can be articulated to one another via a longitudinal folding line, each longitudinal area being intended to form a longitudinal face of the packaging device, at least one of the longitudinal areas being further articulated at each of its longitudinal ends to an end area, via a transverse folding line, each end area being adapted to form a substantially transverse end face of the packaging device.

The blank in accordance with the invention includes, at one of its longitudinal ends at least, longitudinal shock absorbing means situated at the level of the longitudinal folding line and spaced longitudinally and/or extending to a point spaced longitudinally from the transverse folding line or lines at the corresponding longitudinal end of the blank.

In the context of the present invention, shock absorbing means are to be understood as means configured to attenuate the effects of an impact, in particular if dropped. They may be configured to absorb some of the forces resulting from the impact, for example by allowing elastic and/or plastic deformation of the device. For example, they may be designed to be deformed by spreading or compression of a portion of the device. They may be formed by thinning, weakening or providing localized openings in the blank.

The presence of these shock absorbing means therefore and advantageously enables longitudinal deformation of the packaging device because of an external impact, which greatly reduces the risk of the packaging device breaking.

The shock absorbing means are preferably situated on the longitudinal folding line.

The shock absorbing means may in particular be disposed at least in part beyond a transverse junction plane substantially orthogonal to the longitudinal folding line and passing substantially through the transverse ends of the transverse folding line or lines at the corresponding longitudinal end of the blank, i.e. the transverse folding line or lines situated at the same end as said shock absorbing means and adjacent the longitudinal folding line. The shock absorbing means may in particular extend from one longitudinal end of the blank and beyond the transverse junction plane. They may equally be disposed in a longitudinal end area of the blank, for example in the vicinity of a longitudinal end of the blank, and at a distance from the transverse junction plane.

The blank may include shock absorbing means at each of its longitudinal ends.

Said shock absorbing means may include one or more slots, orifices, grooves and/or notches.

Each longitudinal area may be articulated to an end area at each of its longitudinal ends via a transverse folding line.

In accordance with a first embodiment, the shock absorbing means include at least one slot that extends from at least one longitudinal end of the blank along the longitudinal folding line and beyond a transverse junction plane substantially orthogonal to the longitudinal folding line and passing substantially through the transverse ends of the transverse folding line or lines at the corresponding longitudinal end of the blank.

The or each slot may have a peripheral contour of U, C, V or O shape.

A slot may extend over the longitudinal folding line from each longitudinal end of the blank.

One of the longitudinal areas may be articulated a longitudinal flap via another longitudinal folding line to and at least one slot may extend over said other longitudinal folding line from one or each longitudinal end of the blank and beyond a transverse junction plane substantially orthogonal to said other folding line and passing substantially through the transverse ends of the transverse folding line at the corresponding longitudinal end of the blank.

In accordance with a second embodiment, the shock absorbing means include at one or each longitudinal end of the blank at least one orifice situated on the longitudinal folding line and at a distance from a transverse junction plane substantially orthogonal to the longitudinal folding line and passing substantially through the transverse ends of the transverse folding line or lines at the corresponding longitudinal end of the blank.

The or each longitudinal folding line may include two, four or six shock absorbing orifices.

The orifice, or each orifice, may be of circular, oval, rectangular or square section.

The orifice or at least one of the orifices may be connected to at least one groove, which preferably extends in a substantially transverse direction.

The or each groove may be substantially parallel to the nearest transverse folding line.

When there is more than one groove, the latter may substantially parallel.

The groove or each groove may extend over substantially all the transverse dimension of the longitudinal area or areas.

At least one of the grooves may lead onto an external longitudinal face of one or more longitudinal areas.

Each orifice may be connected to a single groove situated on only one side of the longitudinal folding line, over a longitudinal area, or to two grooves situated on respective opposites sides of the orifice, over two longitudinal areas.

The blank may be made from a plastic material, preferably transparent or translucent, and preferably a rigid plastic material. The material may therefore be chosen from PET (polyethylene terephthalate), PVC (polyvinyl chloride) or PP (polypropylene). The blank may equally be made of cardboard.

Said at least two longitudinal areas may include openings configured so that after the packaging device is assembled they form a passage for an element for hanging up the packaging device. The openings are of "European hole" shape, for example, or any other shape allowing the passage of the hanging up element.

The blank may include only two longitudinal areas.

The transverse folding lines may have a curved shape the convex sides of which are oriented toward one another so that after assembling it the packaging device has two convex curved longitudinal faces and two concave curved transverse faces.

The invention also consists in a device for packaging at least one windscreen wiper, the packaging device being assembled from a blank as described above.

The packaging device may contain at least one windscreen wiper, in particular at least one curved blade windscreen wiper.

The invention finally consists in a method of assembling a device for packaging at least one windscreen wiper by means of a blank as described above, preferably a single blank, the method including bending and even gluing and/or welding steps.

The invention will be better understood and other details, features and advantages of the invention will appear on reading the following description given by way of nonlimiting example and with reference to the appended drawings, in which.

Figure 1:
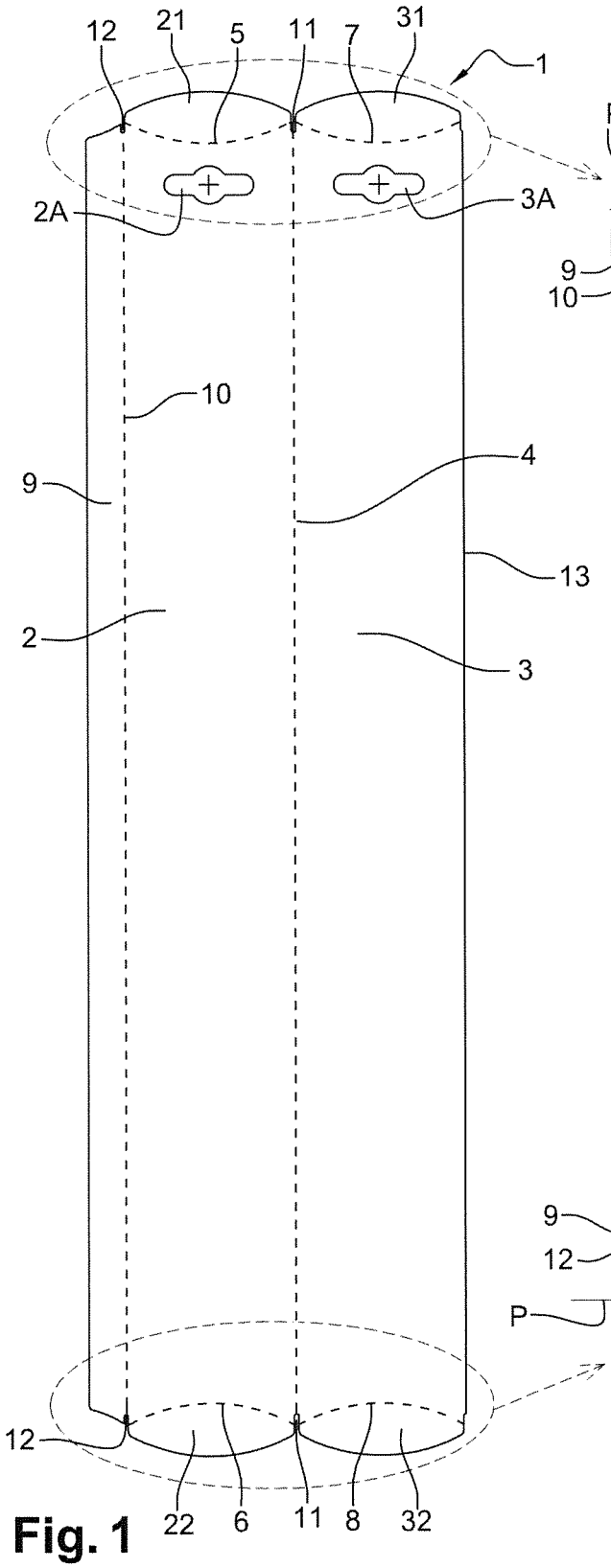
FIG. 1 is a front view in a plane unfolded position of a blank in accordance with a first embodiment of the invention for assembling a device for packaging at least one windscreen wiper.
Figure 7:
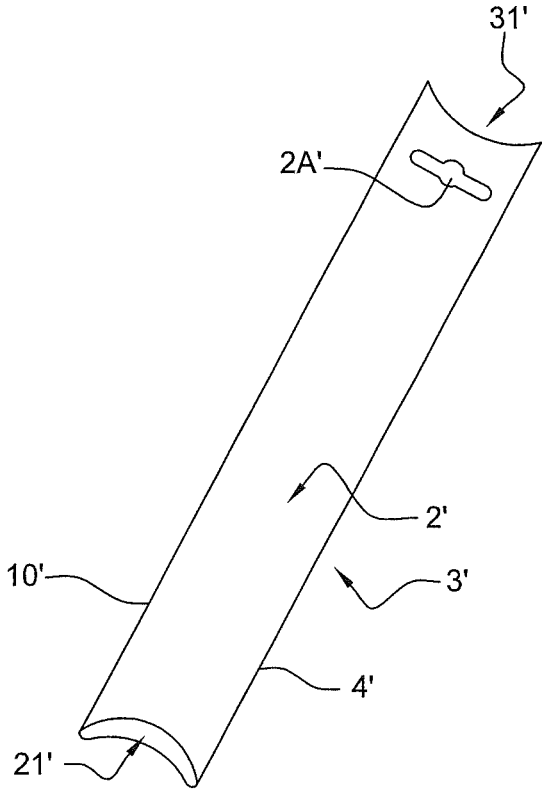
FIG. 7 is a view of a packaging device assembled from the FIG. 1 blank.

As shown in FIG. 1, a blank 1 in accordance with the invention for assembling a device for packaging at least one windscreen wiper includes at least two longitudinal areas 2, 3 articulated to one another by a longitudinal folding line 4. For example, FIG. 1 shows a blank with only two longitudinal areas 2, 3, which will yield a packaging device having two longitudinal lateral faces, for example a front face 2' and a rear face 3' joined by edges 4' and 10' (FIG. 7). There may nevertheless be envisaged a packaging blank 1 including more than two longitudinal areas, the plurality of longitudinal areas then defining a polygonal longitudinal profile for the packaging device once assembled.

Each longitudinal end of at least one longitudinal area 2, 3, and preferably both of them, is articulated to an end area 21, 22; 31, 32 via a transverse folding line 5, 6; 7, 8, namely two upper end areas 21, 31 and two lower end areas 22, 32. The two upper end areas 21, 31 are intended to form a substantially transverse end face of the packaging device, the two lower end areas 22, 32 being intended to form the other substantially transverse end face of the packaging device.

The transverse folding lines 5, 6, 7, 8 may be curved, notably of circular arc shape, and their convex sides may be oriented toward one another so that when assembled the packaging device has convex curved front longitudinal faces 2' and 3' and two concave curved transverse faces 21',31' (FIG. 7).

Each longitudinal area 2,3 may include in its upper portion an opening 2A, 3A such that after assembling the packaging device the openings 2A, 3A form a passage 2A' for an element for hanging up the packaging device (FIG. 7).

The blank 1 advantageously includes a longitudinal flap 9 that is adjacent one longitudinal area 2 and is articulated to that longitudinal area 2 via a second longitudinal folding line 10. Here the longitudinal folding lines 4, 10 are substantially parallel.

The longitudinal area 2 is bordered by the transverse folding lines 4, 5, 6, 10 which impose its shape on it and the longitudinal area 3 is bordered by the folding lines 4, 7, 8 and by a free longitudinal edge 13. The longitudinal areas 2, 3 have globally the same shape. The end areas 21, 22, 31, 32 also have globally the same shape.

The longitudinal flap 9 is advantageously a flap that makes it possible, when assembling the packaging device, to cause one face of this flap 9 to adhere by means of an adhesive, glue, welding to a portion of a face of the longitudinal area 3, preferably so that the lines 10, 13 substantially coincide. The packaging device then has a transversely closed contour comprising the longitudinal faces 2',3' of the packaging device.

In accordance with the invention, at one of its longitudinal ends at least, the blank 1 includes longitudinal shock absorbing means situated at the level of the longitudinal folding line 4 and spaced longitudinally (and/or extending as far as a longitudinally spaced point) from the transverse folding line or lines 5, 6, 7, 8 of the corresponding longitudinal end of the blank 1.

Figure 2A:
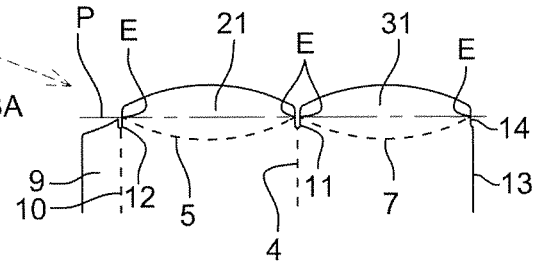
FIG. 2A is a detail view of a first longitudinal end or the upper portion of the blank from FIG. 1.
Figure 2B:
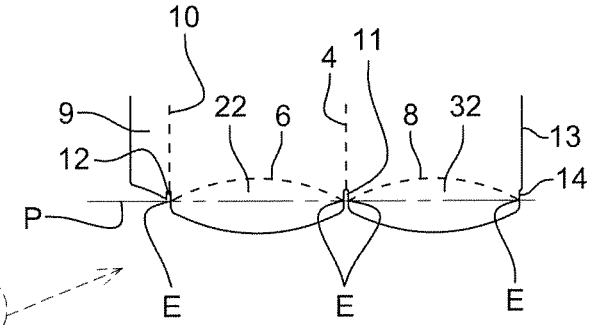
FIG. 2B is a detail view of a second longitudinal end or the lower portion of the blank from FIG. 1.
Figure 3:
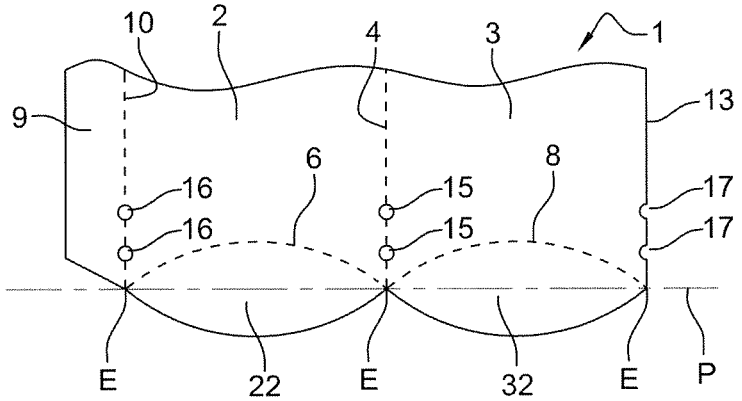
FIG. 3 is a detail view of the lower portion of a blank in accordance with a second embodiment.

In a first embodiment, as shown in FIGS. 1, 2A and 2B, the shock absorbing means include a slot 11, optionally passing right through them, that extends from each longitudinal end of the blank 1, along the longitudinal folding line 4, and beyond (i.e. at the same end as the longitudinal areas 2, 3) a transverse junction plane P substantially orthogonal to the longitudinal folding line 4 and passing substantially through the transverse ends E of the transverse folding lines 5, 6, 7, 8 of the corresponding longitudinal end of the blank 1.

At the upper or top end of the blank 1, the slot 11 therefore extends along the longitudinal folding line 4 from the upper longitudinal end of the blank 1 and below the plane P substantially orthogonal to the longitudinal folding line 4 and passing substantially through the transverse ends E of the transverse folding lines 5, 7 of the upper end of the blank 1 (FIG. 2A).

In the same way, at the lower or bottom end of the blank 1, the slot 11 extends along the longitudinal folding line 4 from the lower longitudinal end of the blank 1 and above the plane P substantially orthogonal to the longitudinal folding line 4 and passing substantially through the transverse ends E of the transverse folding lines 6, 8 of the lower end of the blank 1 (FIG. 2B).

The slot 11 may have various shapes, and may notably have a peripheral contour of U, C, V or O shape, for example. The slot 11 or each slot 11 may have a longitudinal dimension between 0.5 and 10 mm and preferably between 1 and 5 mm.

Thanks to the presence of the slots 11, play is created at the level of the end zones 21, 22, 31, 32 of the blank 1 and therefore at the level of the transverse end faces of the packaging device, which makes it possible to create a shock absorbing effect at the level of the slots 11 in the event of an impact or of the packaging device being dropped.

The shock absorbing means advantageously include, at one longitudinal end of the blank 1 at least, and preferably at both longitudinal ends of the blank 1, another slot 12 extending over the second longitudinal folding line 10 from one longitudinal end of the blank 1 and beyond the transverse junction plane P. An improved shock absorbing effect is therefore obtained, because play is provided at each transverse end of the blank 1, and consequently at each transverse end of the packaging device. The slot 12 or the slots 12 extending over the second longitudinal folding line 10 advantageously have the same longitudinal and transverse dimensions as the slot 11 or the slots 11 extending over the first longitudinal folding line 10.

The shock absorbing means may also include, on the longitudinal edge 13 of the blank 1 opposite the longitudinal flap 9, an opening (a notch) 14 that extends from at least one longitudinal end of the blank 1 and beyond the transverse junction plane P. The opening 14 advantageously has substantially the same longitudinal dimension as the slots 11 and 12 and a transverse dimension that is substantially half the transverse dimension of the slots 11, 12, thus forming substantially a half-slot. During assembly of the packaging device, the opening 14 is advantageously superposed on a portion of the corresponding slot 12 situated on the same side as the longitudinal flap 9 and situated at the same height, which contributes to an improved shock absorbing effect of the packaging device once assembled.

In a second embodiment, which may be combined with the first embodiment, the longitudinal shock absorbing means include, in a longitudinal end portion of the blank 1, and preferably in both longitudinal end portions of the blank 1, namely an upper end portion and a lower end portion of the blank 1, at least one orifice 15, and preferably a plurality of orifices, situated on the longitudinal folding line 4 and at a distance from the transverse junction plane P as defined above. The orifice 15 or the orifices 15 make it possible to create shock absorbing areas in the form of bellows.

The shock absorbing means advantageously further include at least one orifice 16, and preferably a plurality of orifices, situated on the second longitudinal folding line 10 and at a distance from the transverse junction plane P. The orifice 16 or the orifices 16 are preferably situated at the same h eight as the orifice 15 or the orifices 15 and preferably have the same longitudinal and transverse dimension.

As shown in FIGS. 3 to 6, the orifices 15 and 16 are of circular shape, but other shapes may be envisaged, in particular rectangular, square or lozenge-shaped or elliptical orifices.

The shock absorbing means may also include, on the longitudinal edge 13 of the blank 1 opposite the longitudinal flap 9, at least one opening (a notch) 17, and preferably a plurality of them, situated at a distance from the transverse junction plane P passing through the transverse ends of the transverse folding line 4 and preferably at the same height as the orifice 16 or the orifices 16 situated on the second longitudinal folding line 10. The opening 17 advantageously has substantially the same longitudinal dimension as the orifices 15 and 16 and a transverse dimension substantially equal to half the transverse dimension of the orifices 15 and 16, therefore forming substantially a half-orifice. When folding the blank 1 to assemble the packaging device, the opening 17 is superposed on a portion of the corresponding orifice 16 on the same side as the longitudinal flap 9 and of the same height, which contributes to a better shock absorbing effect of the packaging device once assembled.

Figure 4:
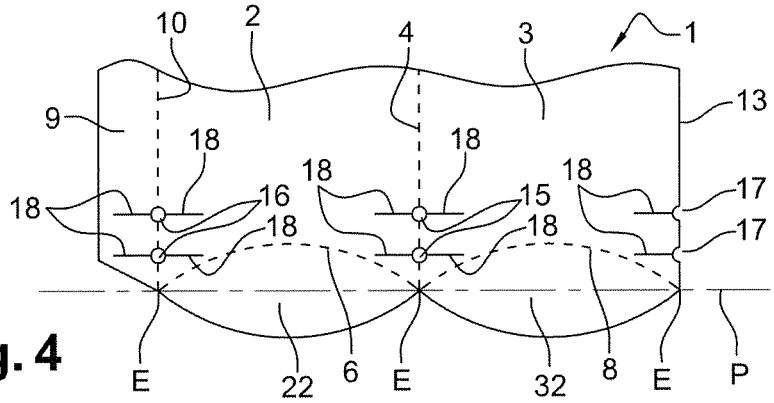
FIG. 4 is a detail view of the lower portion of a blank in accordance with a first variant of the second embodiment.

In a variant of this second embodiment, at least one of the orifices 15, 16 and/or at least one of the openings 17 is connected to at least one groove (or through-slot) 18 that preferably extends in a substantially transverse direction (FIG. 4). The presence of each groove 18 makes it possible to strengthen the shock absorbing effect by forming shock absorbing bellows with greater transverse dimensions in the packaging device once assembled.

Figure 5:
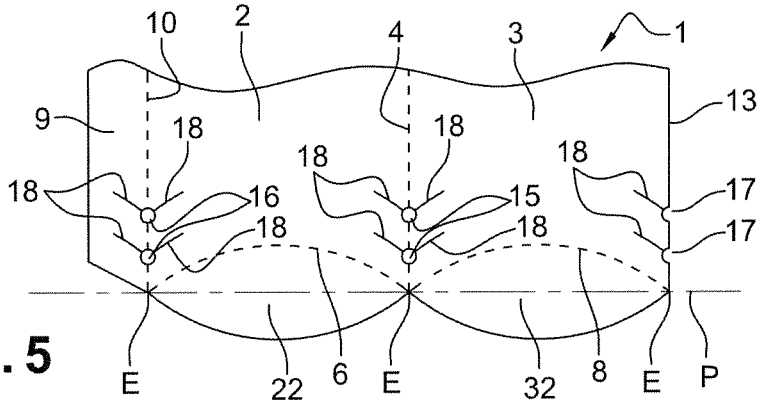
FIG. 5 is a detail view of the lower portion of a blank in accordance with a second variant of the second embodiment.
Figure 6:
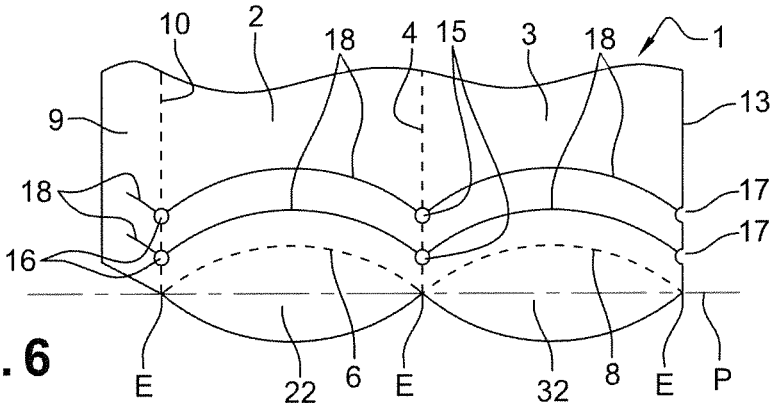
FIG. 6 is a detail view of the lower portion of a blank in accordance with a third variant of the second embodiment.

Each groove 18 is advantageously substantially parallel to the nearest transverse folding line (FIGS. 5 and 6). Each orifice 15, 16 may be connected to a single groove situated on only one side of the longitudinal folding line 4, in a longitudinal area 2, 3, or preferably to two grooves 18 situated on respective opposite sides of the orifice 15, 16, in two longitudinal areas 2, 3 or in the longitudinal flap 9 and in the longitudinal area 3 adjacent the flap 9. In the variant shown in FIG. 6, the grooves 18 extend substantially all of the transverse dimension of the longitudinal areas 2, 3. Each groove 18 situated in the longitudinal flap 9 may also extend over a major portion of the transverse dimension of the flap 9.

The grooves 18 may be formed on one of the faces or on both the faces of the longitudinal areas 2, 3. The orifices 15, 16 have a diameter between 0.5 and 5 mm, for example, and preferably between 1 and 3 mm.

The blank 1 described above is used to produce a device for packaging at least one windscreen wiper, as shown in FIG. 7. Assembling the packaging device may include the following steps:

a step of folding the blank 1 along the longitudinal folding line 4 so as to cause a face of the flap 9 to adhere to a portion of a face of the longitudinal area 3, preferably so that the longitudinal folding lines 10, 13 substantially coincide, a step of fastening the flap 9 to the edge 13, for example by gluing them (the glue may be already present on the flap 9 or applied thereto), the device then having a transversely closed contour comprising the longitudinal faces 2',3' of the packaging device, and a step of folding the end areas 21, 22, 31, 32 of the blank 1 toward the interior of the transversely closed contour so as to form the transverse faces 21',31' of the device.

Figure 8A:
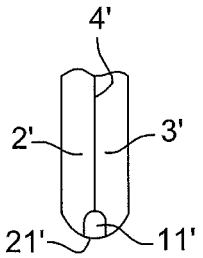
FIG. 8A is a detail view of the lower end of a packaging device in accordance with the invention assembled from a blank in accordance with the first embodiment, the packaging device being in a normal position.
Figure 8B:
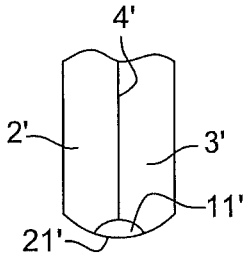
FIG. 8B is a detail view of the lower end of a packaging device in accordance with the invention assembled from a blank in accordance with the first embodiment, the packaging device being in a deformed position.

FIG. 8A shows the bottom end of a device assembled from a blank in accordance with the first embodiment at rest, in a normal, non-deformed configuration. If the bottom end of the device is subjected to an impact, the area situated around the slot 11' will be deformed, thus protecting the device and its contents. FIG. 8B shows the bottom end of the device in its deformed position, the slot 11' having adopted a more open shape, for example a more open V-shape.

Figure 9A:
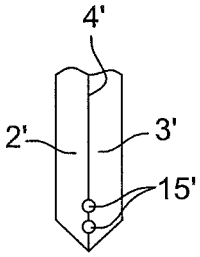
FIG. 9A is a detail view of the lower end of a packaging device in accordance with the invention assembled from a blank in accordance with the second embodiment, the packaging device being in a normal position.
Figure 9B:
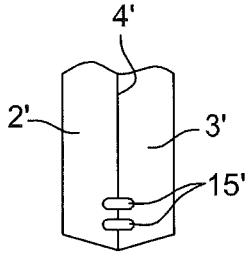
FIG. 9B is a detail view of the lower end of a packaging device in accordance with the invention assembled from a blank in accordance with the second embodiment, the packaging device being in a deformed position.

In the same way, FIG. 9A shows the bottom end of a device assembled from a blank in accordance with the second embodiment at rest, in a normal, non-deformed configuration. If the bottom end of the device is subjected to an impact, the area situated around the orifices 15' will be deformed, for example in compression, thereby protecting the device and its contents. FIG. 9B shows the bottom end of the device in its deformed position.

The packaging device is suitable for packaging windscreen wipers and especially for packaging flat blade type curved blade wipers. A rigid material is preferably used for the blank, for example a plastic material chosen from PET (polyethylene terephthalate), PVC (polyvinyl chloride) or PP (polypropylene). The blank may equally be made of cardboard. The blank has a thickness between 0.1 and 1 mm, for example, and preferably between 0.2 mm and 0.6 mm.

The invention claimed is:

1. A blank for assembling a packaging device for packaging at least one windscreen wiper, said blank being of elongate shape and comprising:

at least two adjacent longitudinal areas articulated to one another via a longitudinal folding line, each longitudinal area forming a longitudinal face of the packaging device, at least one of the longitudinal areas being further articulated at each of two longitudinal ends to an end area, via a transverse folding line, each end area being adapted to form a substantially transverse end face of the packaging device; and at one of the two longitudinal ends is provided with longitudinal shock absorbing means comprising a slot, wherein the slot is situated at the level of the longitudinal folding line and extends longitudinally from the at one of the two longitudinal ends towards the other of the two longitudinal ends to a point spaced longitudinally from the transverse folding line, wherein the slot extends from the at least one longitudinal end of the blank along the longitudinal folding line and beyond a transverse junction plane substantially orthogonal to the longitudinal folding line and passing substantially through transverse ends of the transverse folding line, and wherein, when each end area is folded along each transverse folding line to form the transverse end face, the slot extends beyond the transverse junction plane to the point spaced longitudinally from the transverse folding line to form the longitudinal shock absorbing means.

2. The blank according to claim 1, further comprising shock absorbing means at each of its longitudinal ends.

3. The blank according to claim 1, wherein each longitudinal area is articulated to an end area at each of the longitudinal ends via a transverse folding line.

4. The blank according to claim 1, wherein the slot extends over the longitudinal folding line from each longitudinal end of the blank.

5. The blank according to claim 4, wherein one of the longitudinal areas is articulated to a longitudinal flap via another longitudinal folding line, and wherein another slot extends over said other longitudinal folding line from one or each longitudinal end of the blank and beyond a transverse junction plane substantially orthogonal to said other folding line and passing substantially through the transverse ends of the transverse folding line at the corresponding longitudinal end of the blank.

6. The blank according to claim 1, wherein the blank is made from a transparent or translucent plastic material.

7. The blank according to claim 1, wherein said at least two longitudinal areas include openings configured so that after assembly of the packaging device they form a passage for an element for hanging up the packaging device.

8. The blank according to claim 1, wherein the transverse folding lines have a curved shape, and wherein the convex sides of which are oriented toward one another so that after it is assembled the packaging device has two convex curved longitudinal faces and two concave curved transverse faces.

9. A packaging device for packaging at least one windscreen wiper, the packaging device comprising:

at least two adjacent longitudinal areas articulated to one another via a longitudinal folding line, each longitudinal area forming a longitudinal face of the packaging device, at least one of the longitudinal areas being further articulated at each of two longitudinal ends to an end area, via a transverse folding line, each end area being adapted to form a substantially transverse end face of the packaging device;

at one of the two longitudinal ends is provided with longitudinal shock absorbing means comprising a slot; and at least one windscreen wiper, wherein the slot is situated at the level of the longitudinal folding line and extends longitudinally from the at least one of the two longitudinal ends towards the other of the two longitudinal ends to a point spaced longitudinally from the transverse folding line, wherein the slot extends from the at least one longitudinal end of the blank along the longitudinal folding line and beyond a transverse junction plane substantially orthogonal to the longitudinal folding line and passing substantially through transverse ends of the transverse folding line, and wherein, when each end area is folded along each transverse folding line to form the transverse end face, the slot extends beyond the transverse junction plane to the point spaced longitudinally from the transverse folding line to form the longitudinal shock absorbing means.

* * * * *